United States Patent [19]

Walter

[11] Patent Number: 5,049,093

[45] Date of Patent: Sep. 17, 1991

[54] CARD EDGE ELECTRICAL CONNECTOR

[75] Inventor: Dennis P. Walter, Plantation, Fla.

[73] Assignee: Motorola, Inc., Schaumburg, Ill.

[21] Appl. No.: 422,266

[22] Filed: Oct. 16, 1989

[51] Int. Cl.[5] ..... H01R 9/05

[52] U.S. Cl. ..... 439/581; 439/930

[58] Field of Search ..... 439/581, 578, 63, 930; 333/260

[56] References Cited

U.S. PATENT DOCUMENTS 2,858,515 10/1958 Thunander et al. ..... 439/623

3,594,708 7/1971 Lalonde ..... 439/581

4,801,269 1/1989 Howard et al. ..... 439/581

*Primary Examiner*—Neil Abrams

*Attorney, Agent, or Firm*—Michael J. Buchenhorner

[57] ABSTRACT

A radio-frequency connector (10) comprises a connector member (12) and a coaxial cable (20) coupled to the connector member (12). The connector member (12) includes a ground contact (19) and a slot (16) for receiving a card-shaped object (14). The coaxial cable (20) includes a central conductor (30) providing an electrical contact for the connector member (12) and a shield (28) connected with an electrical contact (18) to ground potential.

6 Claims, 2 Drawing Sheets

CARD EDGE ELECTRICAL CONNECTOR

TECHNICAL FIELD

This invention relates generally to connectors and more specifically to connectors of the card edge type.

BACKGROUND

In radio systems, a radio-frequency (RF) contact is often coupled to circuitry on a substrate having the thickness of an ordinary credit card. In addition, such contacts may require connectors that allow quick connection and disconnection with low insertion loss. Insertion loss results from poor impedance matching between the RF contact and the circuitry. Therefore, a connector providing a good impedance match between an RF contact (e.g., a coaxial cable) and a circuit on a substrate is needed.

SUMMARY OF THE INVENTION

Accordingly, it is an object of the present invention to provide a connector that may be used to couple a radio frequency contact to a circuit on a thin substrate with low insertion loss.

Briefly, according to the invention, a connector comprises a connector member and a coaxial cable coupled to the connector member. The connector member includes at least one electrical contact and a slot for receiving a card-shaped object and the coaxial cable includes a central conductor, providing an electrical contact for the connector member, and a shield, coupled, with an electrical contact of the connector member, to ground potential.

DETAILED DESCRIPTION OF THE PREFERRED EMBODIMENT

Figure 1:
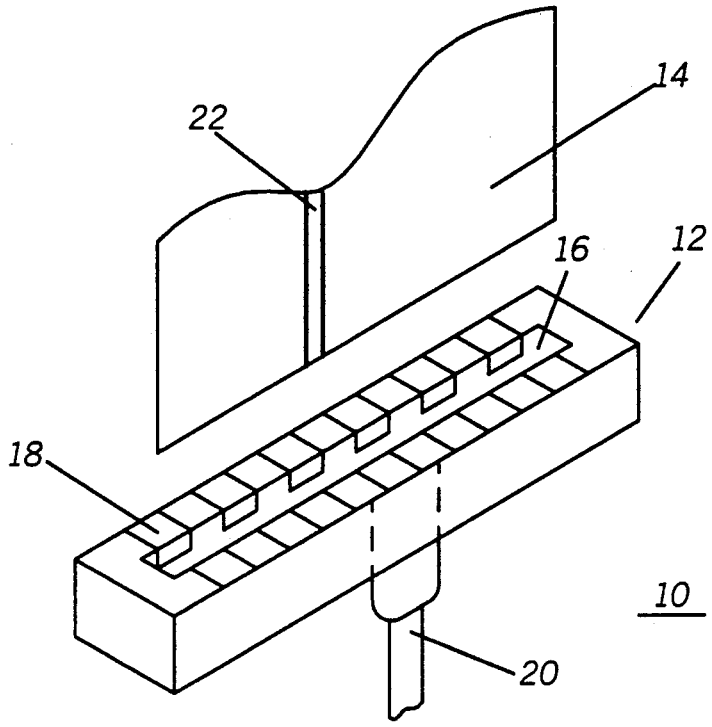
FIG. 1 shows a connector in accordance with the present invention.

Referring to FIG. 1, a connector 10 in accordance with the present invention is shown. The connector 10 includes a main body 12 having a slot 16 for receiving a card-shaped object (or card) 14. The main body 12 may be a commercially-available card edge connector. The card-shaped object 14 may be a printed circuit board or another connecting means; it includes a conducting strip 22 (a hidden groundstrip can be provided for a microstrip), in this embodiment. The connector 10 also comprises a plurality of electrical contacts 18 that are aligned with the corresponding electrical contacts (not shown) on the card 14. A coaxial cable 20 is coupled to the main body 12 to provide or receive signals (e.g., an RF signal). The coaxial cable may be a commercially-available 50 Ohm semi-rigid round cable (preferably having a diameter of 0.141 in.).

Figure 2:
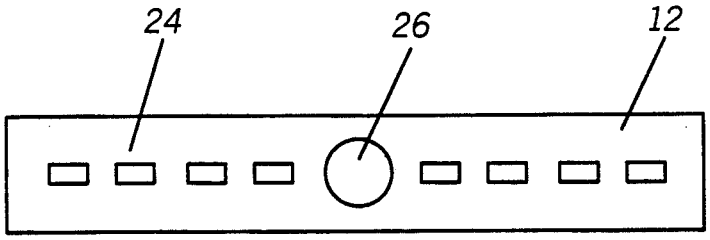
FIG. 2 is a view of the rear portion of the connector.

Referring to FIG. 2, the rear portion of the main body 12 is shown. A hole 26 (preferably having a 9/64 in. diameter) is drilled into the rear portion of the main body 12 for receiving an end of the cable 20. A plurality of connectors 24 extend from the rear of the body 12 for providing interconnections to contacts 18. In the event that a standard card edge connector is used two of the connectors 24 may be removed to provide the required area for drilling the hole 26.

Figure 3:
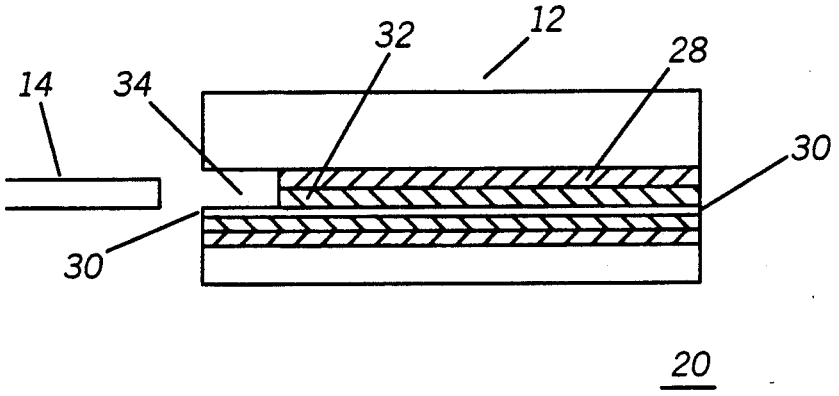
FIG. 3 shows a cross section of a coaxial cable that may be used with the connector.

Referring to FIG. 3, a lengthwise cross section of the cable 20 is shown. A central conductor 30 is located within an insulating layer 32 (preferably polytetrafluoroethelyne) surrounds the central conductor 30. A shield 28 (preferably a copper jacket) surrounds the insulating layer 32. An end 34 of the cable 20 has been prepared for insertion into the hole 26 by stripping away a portion of the shield 28 and a portion of the insulating layer 32, thus exposing a portion of the central conductor 30 so that it may be coupled to a corresponding contact on the card 14 when that card is inserted into the slot 16.

Figure 4:
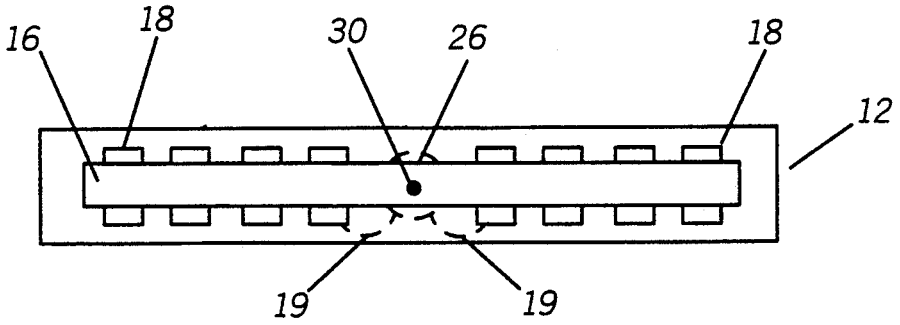
FIG. 4 is a front view of the connector.

Referring to FIG. 4, a view of the front of the main body 12 is shown. From this view, one may appreciate how the contacts 18 may be coupled to contacts on a card or other thin substrate. Part of the end 34 of the cable 20 is visible through the slot 16. A pair of connections 36 are made from the shield 28 to a pair of contacts 19 (designed to be at ground potential). The other contacts 18 may be used to make various other connections. The connections 36 also provide at least part of the mechanical attachment between the main body 12 and the cable 20.

Figure 5:
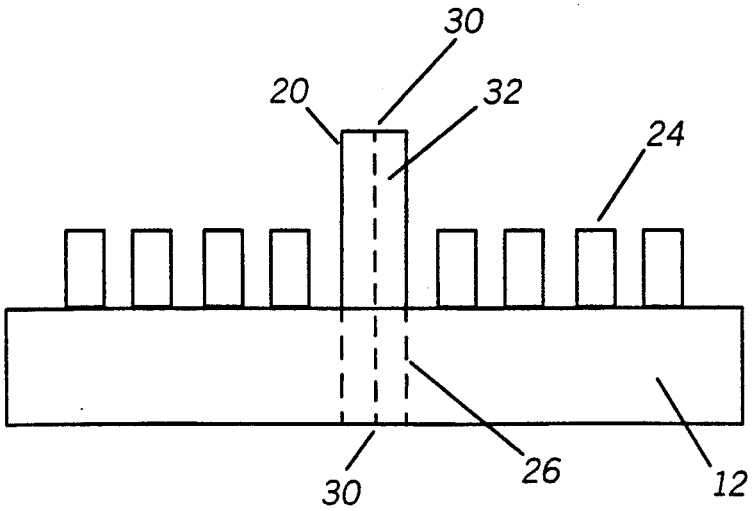
FIG. 5 is a top view of the connector.

Referring to FIG. 5, a top view of the main body 12 of the connector 10 is shown. The cable 20 is connected to the main body by inserting the end 34 with stripped portions into the hole 26. The connectors 24 are each connected to a contact 18 on the opposite side of the main body 12. These connectors may be used to provide alternating or direct signals or additional RF signals. Slimness of the main body is maintained by avoiding the need for a bulky connector on the card 14. In addition, the manner of connecting the cable 20 to the main body 12, just described, provides a good impedance match, thus lowering the insertion loss.

What is claimed is:

1. A radio-frequency connector comprising:

a connector member comprising at least one electrical contact and a slot for receiving a card-shaped object; and a coaxial cable having a coupling end coupled to the connector member, the coaxial cable comprising a central conductor, an insulating layer around the central conductor, and a shield, around the insulating layer;

the coupling end having a portion of the shield and a portion of the insulating layer stripped and having a portion of the conductor exposed to provide an electrical contact for connecting in a direct manner to a contact on the card-shaped object;

and wherein the shield is coupled, with an electrical contact of the connector member, to provide a ground connection.

2. The connector of claim 1, wherein the connector member has a receptacle therein and wherein the coupling end of the coaxial cable fits within the receptacle.

3. The connector of claim 2, wherein the shield comprises a metal jacket.

4. The connector of claim 2, wherein the insulating layer comprises polyetrafluorethelyne.

5. A method for connecting a coaxial cable, having a central conductor, an insulating layer, and a shield, to a card edge connector, having at least one electrical contact, comprising the steps of:

(a) stripping a portion of the shield and a portion of the insulating layer at an end of the coaxial cable, so that a portion of the central conductor is exposed;

(b) inserting the stripped end of the coaxial cable into a receptacle in the card edge connector;

(c) attaching the stripped end of the coaxial cable to the card edge connector so that the exposed conductor can make contact in a direct manner to a card inserted in the edge connector; and (d) connecting an electrical contact of the card edge connector to the shield.

6. The connector of claim 5, further comprising the step of:

(e) connecting an electrical contact of the card edge connector to the central conductor.

* * * * *